US010002735B2

(12) United States Patent
O'Connor

(10) Patent No.: US 10,002,735 B2
(45) Date of Patent: Jun. 19, 2018

(54) TRIP LIGHT CIRCUIT BREAKER

(71) Applicant: John J. O'Connor, Kansas City, MO (US)

(72) Inventor: John J. O'Connor, Kansas City, MO (US)

( * ) Notice: Subject to any disclaimer, the term of this patent is extended or adjusted under 35 U.S.C. 154(b) by 0 days. days.

(21) Appl. No.: 15/000,533

(22) Filed: Jan. 19, 2016

(65) Prior Publication Data

US 2016/0211100 A1 Jul. 21, 2016

Related U.S. Application Data

(60) Provisional application No. 62/125,369, filed on Jan. 21, 2015.

(51) Int. Cl.

| | |
|---|---|
| ***H01H 9/00*** | (2006.01) |
| ***H01H 71/04*** | (2006.01) |
| ***H01H 71/10*** | (2006.01) |

(52) U.S. Cl.

CPC ..... *H01H 71/04* (2013.01); *H01H 71/10* (2013.01); *H01H 2219/036* (2013.01)

(58) Field of Classification Search

CPC ... H01H 71/04; H01H 71/10; H01H 2219/036
USPC ..... 200/317
See application file for complete search history.

(56) References Cited

U.S. PATENT DOCUMENTS

| | | | | |
|---|---|---|---|---|
| 4,056,816 | A | 11/1977 | Guim | |
| 4,514,723 | A | 4/1985 | Leal | |
| 4,633,240 | A | 12/1986 | Guim et al. | |
| 4,652,867 | A | 3/1987 | Masot | |
| 4,768,025 | A * | 8/1988 | Vila-Masot | H01H 71/04 335/17 |
| 4,969,063 | A | 11/1990 | Scott et al. | |
| 5,517,381 | A | 5/1996 | Guim et al. | |
| 5,874,884 | A | 2/1999 | Hull et al. | |
| 6,542,061 | B2 | 4/2003 | Santa Cruz et al. | |
| 8,008,585 | B2 * | 8/2011 | Mills | H01H 71/1027 200/308 |
| 8,975,545 | B2 | 3/2015 | Smith | |

* cited by examiner

*Primary Examiner* — Edwin A. Leon
*Assistant Examiner* — Lheiren Mae A Caroc
(74) *Attorney, Agent, or Firm* — Erickson Kernell IP, LLC

(57) ABSTRACT

A circuit breaker is referenced that has an indicator lamp that identifies a fault condition after power is interrupted to the circuit breaker. This solution uses light emitting diodes (LEDs) to indicate the trip condition. This solution does not require the power to be enabled to the load side of the circuit breaker in order to power the LEDs to display a trip condition. An overload may be detected when the fault current generates sufficient heat in a strip composed of a resistive element or bimetal to cause the bimetal to deflect and/or bend. The mechanical deflection triggers a trip assembly that includes a spring trip level to force a moveable contact attached to a moveable conductive blade away from a stationary contact, thereby breaking the circuit.

13 Claims, 2 Drawing Sheets

TRIP LIGHT CIRCUIT BREAKER

CROSS REFERENCE TO RELATED APPLICATIONS

This application claims the benefit of appending application Ser. No. 62/125,369, filed on Jan. 21, 2015, entitled TRIP LITE CIRCUIT BREAKER.

FIELD

The present invention generally relates to electrical circuit breaker, and more particularly, to electrical circuit breakers that provide a positive and reliable indication when the circuit breaker has been tripped.

BACKGROUND

Electrical circuit breakers are known in the art. Circuit breakers are electrical switches designed to protect an electrical circuit and its branches (wiring) from damage caused by overloads or short circuits. Its basic function is to detect an overload or electrical short condition and interrupt current flow. Unlike a fuse, which operates once and must be replaced, a circuit breaker can be reset to resume normal operation one the problem has been identified and corrected. Circuit breakers are now an industry standard and commonplace in most homes and commercial spaces worldwide.

Generally a circuit breaker includes a switch coupled to a moving contact, an operating or trip mechanism, and a stationary contact. When the switch is in the OFF position, the moving contact is separated from the stationary contact and the circuit is open whereby current cannot flow through the circuit. When the switch is in the ON position, the moving contact is in contact with the stationary contact and the circuit is closed whereby current flows through the circuit. If there is a short in the circuit too much current flows through the circuit, an electromagnetic short circuit sensing element or a thermal overcurrent sensing element releases the trip mechanism to open the contacts and disrupt current flow through the circuit.

In many cases a breaker in the tripped/fault suite is undetectable because many times the ON/OFF or tripped toggle switch does not fully flip to the tripped or OFF position. When a circuit breaker in fault state is not easily identified it results in the homeowner or electrician systematically resetting each breaker until the actual tripped breaker is located. This process often results in an undesirable disruption of power to other electrical components and may cause a power spike in the circuit damaging sensitive electronics.

An overloaded or short is caused when the load current generates excessive heat due to load in a strip of a bimetal element within the circuit breaker mechanism. The bimetal element is designed to cause the bimetal to deflect and/or bend. The deflection triggers the spring loaded trip mechanism which includes a trip lever to move the conductive blade away from a stationary portion of the bimetal contact, thus breaking the circuit. When the circuit is exposed to a current above its rated level for a period of time, the trip assembly activates and opens the circuit by tripping to the fault state.

Attempts have been made to identify the tripped breaker. Some mechanical systems use bright orange or yellow indicators on an area of the switch that is visible only when the switch is in the tripped or OFF position. These breakers, while useful, are insufficient in low lighting or dark locations, and often fail to fully reach the tripped position, thus not exposing the brightly colored indicator. Additionally, these breakers may also expose the brightly colored indicator when in the ON position, thus defeating the tripped/OFF indicator function.

Other breakers have been proposed that include an indicator lamp that is illuminated when the breaker is in the ON position. While positively identifying the ON breakers, the indicator lamps are constantly burning, wasting energy, and when they burn out, provide a false circuit limit indication. These breakers must be replaced if the indicator lamp burns out, which is costly. Further, if an indicator lamp is burned out, it may create a dangerous situation for an electrician or person working on die circuit; believing that the circuit breaker is off when power is still applied to the affected circuit.

Still other breakers have been proposed that include an indicator lamp that illuminates when the breaker is in the tripped position. The indicator lamp is connected to the line voltage and the common terminal only when in the breaker is in the tripped position. When in the ON or OFF position, the indicator lamp is not illuminated. A problem with these breakers is when the breaker is tripped, the circuit through the indicator lamp is still closed. Thus current is still present in the circuit creating a dangerous situation for an electrician or person working on the circuit, believing that the circuit breaker is off when power is still applied to the affected circuit.

SUMMARY

The present invention relates to a circuit breaker indicator device and particularly to a circuit breaker with an LED fault indicator lamp integrated within the circuit breaker. The improved design instantly identifies a tripped breaker by energizing an indicator lamp when the breaker has tripped, and de-energizing the affected circuit.

The present invention, a circuit breaker, comprised of a plastic housing containing the circuit breaker components including an indicator lamp. The indicator lamp only activates when the circuit has become overloaded and has tripped. The breaker in the tripped position is readily identified and aids in the identification of the electrical circuit to determine what caused the circuit fault.

DETAILED DESCRIPTION

As required, detailed embodiments of the present invention are disclosed herein. However, it is to be understood that the disclosed embodiments are merely exemplary of the inversion that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Moreover, except where otherwise expressly indicated, all numerical quantities in this description and in the claims are to be understood as modified by the word "about" in describing the broader scope of this invention. Practice within the numerical limits stated is generally preferred. Also, unless expressly stated in the contrary, the description of a group or class of materials as suitable or preferred for a given purpose in connection with the invention implies that mixtures or combinations of any two or more members of the group or class may be equally suitable or preferred.

Figure 1:
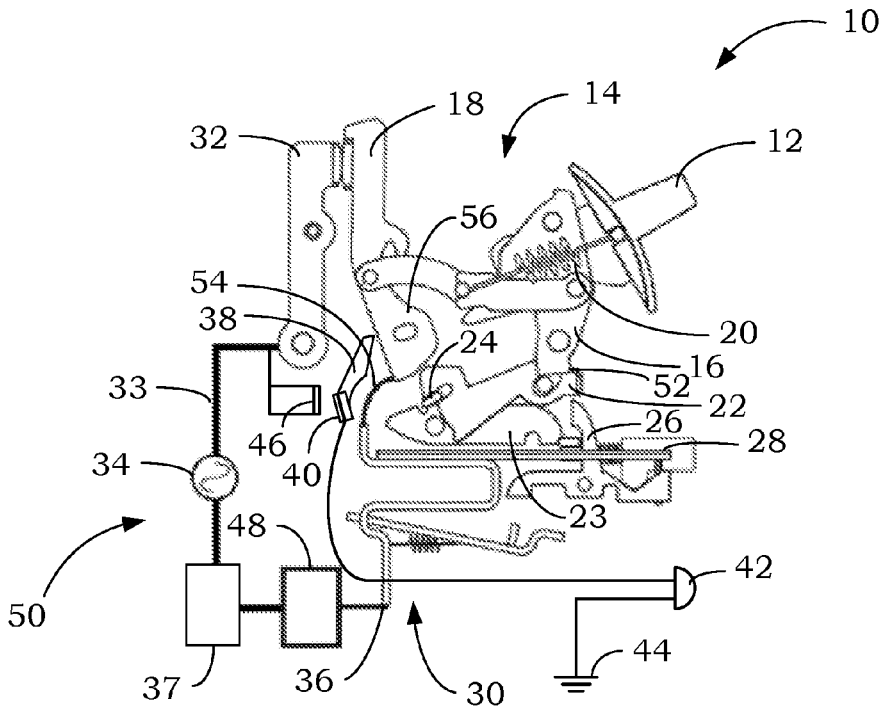
FIG. 1 is an illustrating of an electrical circuit breaker of the present invention in the ON position.

Referring initially to FIG. 1, an illustration of an electrical circuit breaker of the present invention is generally indicated by reference numeral 10. Electrical circuit weaker 10 may also be referred to as circuit breaker 10 or breaker 10. One of ordinary skill in the art will readily recognize and understand the use of any of these descriptions, which are not intended to limit the churned invention. Further, the components described herein are mounted within a housing, which is not shown so as to view the breaker 10 components.

Breaker 10 includes a switch 12 coupled to a latch assembly 14 coupled to an operating mechanism 16 and a moving contact 18. The latch assembly 14 includes a latch spring 20 coupled to the switch 12. Breaker 10 includes an tipper trip arm 22, a lower trip arm 23 with a catch 24, which is designed to engage a notch 25 in one end of the upper trip arm 22. The catch 24 selectively couples the upper trip arm 22 to the lower trip arm 23, which in turn selectively couples the upper trip arm 22 to the operating mechanism 16 to hold the moving contact 18 in the closed or ON position. The lower trip arm 25 is releasably coupled to a tripper bar 26, which is coupled to a bi-metal controller/strip or thermal overcurrent sensing element 28 and an electromagnetic short circuit sensing element 50. The breaker 10 also includes a stationary contact 32 electrically coupled to the hot input 33 from the AC power source 34, and a load terminal 36. Within the breaker panel (not shown) is also a neutral bus bar 37, which is coupled to the neutral line 39 from the AC power source 34. A non-metallic non-conductive indicator arm 38 includes a moveable indicator contact 40 electrically coupled to an indicator light 42, which is electrically coupled to ground 44. A stationary indicator contact 46 is electrically coupled to the power source 34. A load 48 coupled to the bad terminal 36 and the neutral bus bar 37 completes the circuit 50.

As illustrated in FIG. 1, when she switch 12 is in the ON position, moving contact 18 is in contact with stationary contact 32. The latch assembly 14 is held in place by the catch 24, which holds the upper trip arm 22 in an engaged position against the operating mechanism 16, which is biased against a lip 52 at one end of the upper trip arm 22 by the latch spring 20 coupled to the switch 12. In the ON position, current from power source 34 flows through stationary contact 32, moving contact 18, line 54, bi-metal strip 28, electromagnetic short circuit sensing element 30, and load terminal 36 to supply power to load 48. As long as switch 12 is in the ON position, movable indicator contact 40 is spaced from stationary indicator contact 46 and indicator light 42 is off.

Figure 2:
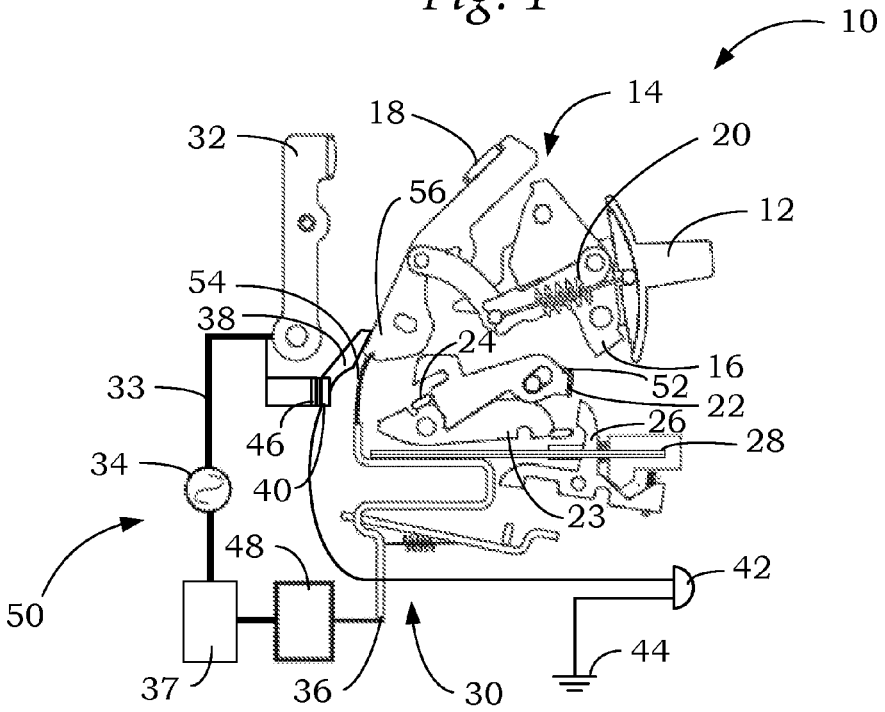
FIG. 2 is an illustration of the electrical circuit breaker of FIG. 1 in the tripped position.

Referring to FIG. 2, if circuit 50 experiences a current overload situation, or a short, then bi-metal controller 28 or electromagnetic short circuit sensing element 50 engages tripper bar 26, which engages lower trip arm 23 and causes lower trip arm 23 to pivot. As the lower trip arm 23 pivots, the catch 24 moves out of an engaged position with the notch 25 in the end of upper trip arm 23, causing the upper trip arm 23 to pivot. When the upper trip arm 23 pivots, the operating mechanism 16 is pivoted away from the upper trip arm 23 by latch spring 20, which causes moving contact 18 pivot and disengage stationary contact 32, thus opening the circuit 50 and disrupting power to the load 48. As the moving contact 18 pivots, a tail end 56 of moving contact 18 engages the indicator arm 38 causing the indicator arm 38 to pivot movable indicator contact 40 into contact with stationary indicator contact 46. When the movable indicator contact 40 is a physical contact with the stationary indicator contact 46, power is supplied to indicator lamp 42 and the lamp 42 is illuminated. As illustrated in FIG. 2, the circuit 50 is open and current from AC source 34 is not delivered to the load 48.

Figure 3:
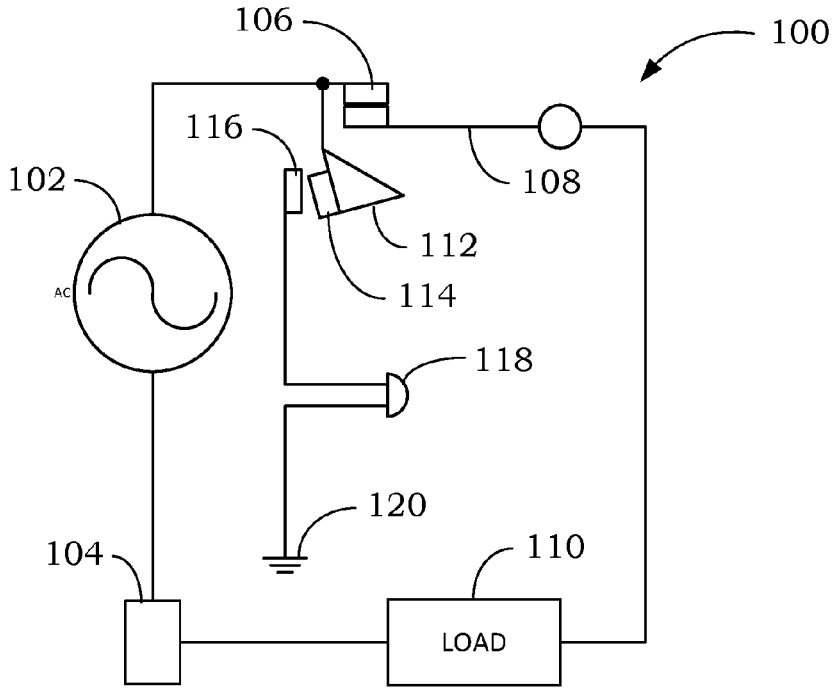
FIG. 3 is a simplified illustration of the electrical circuit breaker of the present inversion in the ON position.
Figure 4:
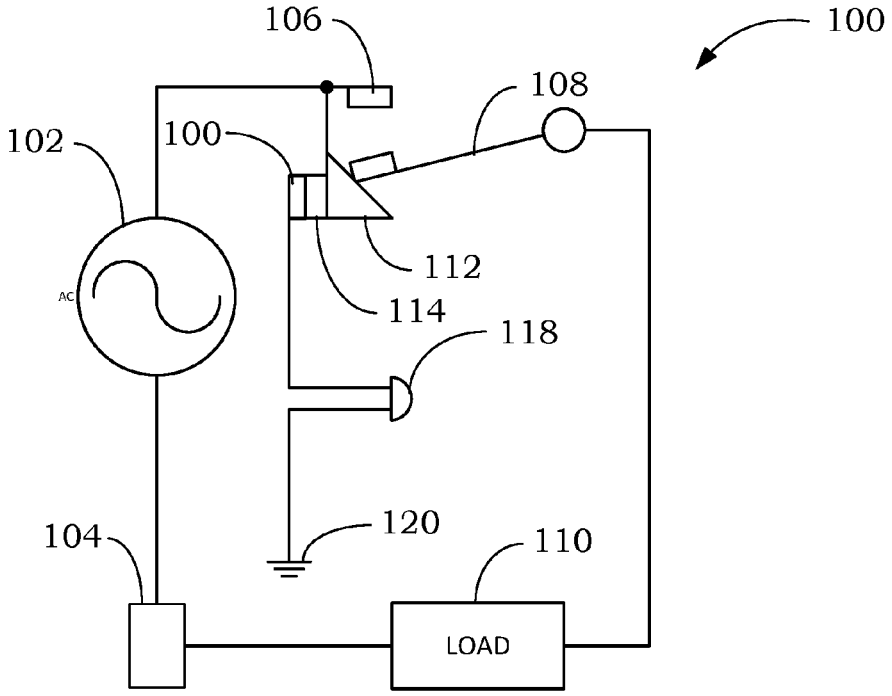
FIG. 4 is a simplified illustration of the electrical circuit breaker of FIG. 3 in the tripped position.

Referring to FIG. 3, a simplified illustration of an electrical circuit breaker of the present invention is generally indicated by reference numeral 100. The neutral side of AC power source 102 is connected to a neutral bus bar 104 mounted in a circuit breaker panel (not shown), and the hot side of AC power source is connected to a stationary contact 106 of breaker 100. In the ON position illustrated in FIG. 3, a movable contact 108 is in contact with the stationary contact 106, thus supplying power to a load 110. When the breaker 100 is tripped, as illustrated in FIG. 4, the movable contact 108 pivots away from the stationary contact 106, opening the circuit, and contacts a moveable indicator block 112, which pivots a movable indicator contact 114 into contact with a fixed indicator contact 116. The fixed indicator contact 116 is electrically connected to the hot side of the AC power source 102. When the movable indicator contact 114 is in contact with the fixed indicator contact 116, power is delivered to an indicator lamp 118, which is connected to ground 120 to complete the circuit and illuminate the lamp 118. In this manner, the lighted lamp 118 readily identifies the circuit breaker 100 that has tripped without continuing to supply current to the load 110.

This is an improved design of a typical residential/light commercial circuit breaker found in most homes and commercial spaces. In many cases an overloaded (tripped) breaker is undetectable because often times the switch does not fully flip to the tripped or off position. Because the switch has not fully flipped and these are after 10 to 20 or more breakers in an electrical panel, the breaker that has tripped is not easily identified, requiring the homeowner or electrician to systematically reset each breaker one at a time until the actual tripped breaker is located. This process often results in an unwanted disruption or power spike in other electrical components downstream (within the structure) from the electrical panel box.

In the preferred embodiment, the indicator lamp is an LED lamp, which only activates upon an overload/tripped breaker thus immediately identifying the breaker that has failed. In certain embodiments, the LED may be protected by resistor and/or coupled to an integrated circuit.

An additional contact point has been added to the line terminal of the breaker and a secondary contact point has been added to the housing of the breaker and attached to the positive lead of the LED lamp. The negative lead from the LED lamp attaches to the grounding bar of the panel box. A non-metallic wedge has been added to the pivot contact allowing power from the LINE SIDE to connect with the contact attached to the breaker housing thus supplying power to the positive lead of the LED lamp in the fault/tripped condition. As with any common circuit breaker, power will not flow to the load side in a fault/tripped state.

The new design with the integrated LED lamp thus allows a person of ordinary skill to reconfigure the electrical load (devices plugged in) on the circuit that is at fault. As can be seen, there is a need for an integrated device that provides an instant visual notification for an overloaded or tripped circuit breaker. The LED indicator lamp in the improved design has been integrated within the circuit breaker housing.

It is to be understood that while certain now preferred forms of this invention have been illustrated and described, it is not limited thereto except insofar as such (imitations are included in the following claims. However, it is to be understood that the principles discussed herein may be applied to other types of circuit breakers.

The invention claimed is:

1. A circuit breaker comprising:

a stationary contact electrically coupled to a power source;

a moving contact pivotable between an on position electrically coupled to said stationary contact and a load terminal, and a tripped position spaced from said stationary contact and electrically decoupled from said load terminal;

a stationary indicator contact electrically coupled to said power source;

an indicator arm having a moveable indicator contact pivotable between an off position wherein said moveable indicator contact is spaced from said stationary indicator contact, and an on position wherein said moveable indicator contact is electrically coupled to said stationary indicator contact; and an indicator lamp electrically coupled to said moveable indicator contact and an electrical ground;

whereas said indicator lamp is off when said moving contact is in said on position;

whereas said indicator lamp is illuminated when said moving contact is in said tripped position and said moveable indicator contact is electrically coupled to said stationary indicator contact.

2. The circuit breaker of claim 1 wherein said moving contact engages said indicator arm when in said tripped position pivoting said indicator arm from said off position to said on position.

3. The circuit breaker of claim 1 wherein said indicator lamp is a light-emitting diode.

4. The circuit breaker of claim 1 wherein said moving contact is further pivotable to an off position spaced from said stationary contact.

5. The circuit breaker of claim 4 wherein said indicator arm remains in said off position when said moving contact pivots to said off position.

6. A circuit breaker comprising:

a stationary contact electrically coupled to a hot side of a power source;

a neutral contact electrically coupled to a neutral side of said power source;

a moving contact pivotable between an on position electrically coupled to said stationary contact and a load terminal, and a tripped position spaced from said stationary contact and electrically decoupled from said load terminal;

a load electrically coupled between said neutral contact and said moving contact;

a stationary indicator contact electrically coupled to said power source;

an indicator arm having a moveable indicator contact pivotable between an off position wherein said moveable indicator contact is spaced from said stationary indicator contact, and an on position wherein said moveable indicator contact is electrically coupled to said stationary indicator contact; and an indicator lamp electrically coupled to said moveable indicator contact and an electrical ground;

whereas said indicator lamp is off when said moving contact is in said on position;

whereas said indicator lamp is illuminated when said moving contact is in said tripped position and said moveable indicator contact is electrically coupled to said stationary indicator contact;

whereas power is disconnected from said load when said moving contact is in said tripped position.

7. The circuit breaker of claim 6 wherein said moving contact engages said indicator arm when in said tripped position pivoting said indicator arm from said off position to said on position.

8. The circuit breaker of claim 6 wherein said indicator lamp is a light-emitting diode.

9. The circuit breaker of claim 6 wherein said moving contact is further pivotable to an off position spaced from said stationary contact.

10. The circuit breaker of claim 9 wherein said indicator arm remains in said off position when said moving contact pivots to said off position.

11. A circuit breaker comprising:

a stationary contact electrically coupled to a hot side of a power source;

a neutral contact electrically coupled to a neutral side of said power source;

a moving contact pivotable between an on position electrically coupled to said stationary contact and a load terminal, and a tripped position spaced from said stationary contact and electrically decoupled from said load terminal;

a load electrically coupled between said neutral contact and said load terminal;

a stationary indicator contact electrically coupled to said power source;

an indicator arm having a moveable indicator contact pivotable between an off position wherein said moveable indicator contact is spaced from said stationary indicator contact, and an on position wherein said moveable indicator contact is electrically coupled to said stationary indicator contact; and a light emitting diode electrically coupled to said moveable indicator contact and an electrical ground;

whereas said light emitting diode is off when said moving contact is in said on position;

whereas said moving contact engages said indicator arm when in said tripped position pivoting said indicator arm from said off position to said on position;

whereas said light emitting diode is illuminated when said moving contact is in said tripped position and said moveable indicator contact is electrically coupled to said stationary indicator contact;

whereas power is disconnected from said load when said moving contact is in said tripped position.

12. The circuit breaker of claim 11 wherein said moving contact is further pivotable to an off position spaced from said stationary contact.

13. The circuit breaker of claim 11 wherein said indicator arm remains in said off position when said moving contact pivots to said off position.

* * * * *